US007348833B2

(12) United States Patent
Fujimoto

(10) Patent No.: US 7,348,833 B2
(45) Date of Patent: Mar. 25, 2008

(54) BIAS CIRCUIT HAVING TRANSISTORS THAT SELECTIVELY PROVIDE CURRENT THAT CONTROLS GENERATION OF BIAS VOLTAGE

(75) Inventor: Shuichiro Fujimoto, Miyazaki (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 11/588,216

(22) Filed: Oct. 27, 2006

(65) Prior Publication Data

US 2007/0046365 A1 Mar. 1, 2007

Related U.S. Application Data

(63) Continuation of application No. 10/995,408, filed on Nov. 24, 2004, now Pat. No. 7,199,644.

(30) Foreign Application Priority Data

Jan. 27, 2004 (JP) ..... 2004-018388

(51) Int. Cl.
*G05F 1/10* (2006.01)

(52) U.S. Cl. ..... 327/538; 323/313; 327/540

(58) Field of Classification Search ..... 327/540, 327/541, 543; 323/313, 315, 901
See application file for complete search history.

(56) References Cited

U.S. PATENT DOCUMENTS 4,342,926 A 8/1982 Whatley
5,047,671 A * 9/1991 Suthar et al. ..... 326/73
5,545,977 A 8/1996 Yamada et al.
5,635,869 A 6/1997 Ferraiolo et al.
5,798,637 A 8/1998 Kim et al.
5,898,618 A * 4/1999 Lakkapragada et al. ..... 365/185.22
6,160,392 A 12/2000 Shin
6,198,339 B1 3/2001 Gersbach et al.
6,667,892 B1 12/2003 Lin et al.
7,046,573 B2 5/2006 Takazawa et al.
2002/0011826 A1 1/2002 Morishita et al.
2003/0214345 A1 11/2003 Yamauchi et al.
2004/0052102 A1 3/2004 Noda
2004/0207380 A1 10/2004 Ariki
2005/0001604 A1 1/2005 Fujimoto

FOREIGN PATENT DOCUMENTS

JP 2001-326535 11/2001

* cited by examiner

*Primary Examiner*—Kenneth B. Wells
*Assistant Examiner*—Thomas J. Hiltunen
(74) *Attorney, Agent, or Firm*—Volentine & Whitt, P.L.L.C.

(57) ABSTRACT

A bias circuit, which generates a bias voltage, has a first MOS transistor coupled between a first reference voltage terminal and a voltage dividing node and a second MOS transistor coupled in parallel with the first MOS transistor. The first MOS transistor may have a first ON-state resistance, and the second MOS transistor may have a second ON-state resistance which is lower than the first ON-state resistance. Furthermore, the bias circuit has a resistance circuit coupled between the voltage dividing node and a second reference voltage terminal and a voltage generator coupled with the first node. The voltage generator outputs the bias voltage in dependence upon an electrical potential on the voltage dividing node.

46 Claims, 4 Drawing Sheets

TABLE 1

| OPERATION MODE | 1st CONTROL SIGNAL S1 | 2nd CONTROL SIGNAL S2 | 1st MOS 26 | 2nd MOS 27 | PMOS 17 | NMOS 18 |
|---|---|---|---|---|---|---|
| START-UP | "L" | "L" | ON | ON | OFF | OFF |
| NORMAL | "L" | "H" | ON | OFF | OFF | OFF |
| STANDBY | "H" | "H" | OFF | OFF | ON | ON |

BIAS CIRCUIT HAVING TRANSISTORS THAT SELECTIVELY PROVIDE CURRENT THAT CONTROLS GENERATION OF BIAS VOLTAGE

CROSS REFERENCE TO RELATED APPLICATIONS

This is a continuation application of application Ser. No. 10/995,408, filed Nov. 24, 2004, now U.S. Pat. No. 7,199, 644, which is hereby incorporated by reference in its entirety for all purposes.

BACKGROUND OF THE INVENTION

1. Field of the Invention

The present invention relates to a semiconductor integrated circuit, and in particular, to a bias circuit which generates a bias voltage in an analog circuit such as an operational amplifier. This is a counterpart of and claims priority to Japanese Patent Application No. 2004-18388 filed on Jan. 27, 2004, which is herein incorporated by reference.

2. Description of the Related Art

FIG. 1 is a circuit diagram showing a bias circuit of the related art. This bias circuit includes a voltage generator 10 which outputs a bias voltage and a start-up circuit 20 which activates the voltage generator 10 in a manner in which the voltage generator 10 outputs a stable bias voltage.

The voltage generator 10 has a P-type conductive Metal Oxide Semiconductor (hereinafter referred to as the "PMOS") transistor 11, a resistance element 12 and an N-type conductive Metal Oxide Semiconductor (hereinafter referred to as the "NMOS") transistor 13 which are connected in series between a power supply voltage terminal Tcc and a ground voltage terminal Tss. The PMOS transistor 11 has a source electrode connected with the power supply voltage terminal Tcc, a drain electrode connected with a first node N1, and a gate electrode connected with a second node N2. The NMOS transistor 13 has a source electrode connected with the ground voltage terminal Tss, a drain electrode connected with the first node N1 through the resistance element 12, and a gate electrode connected with a third node N3. The drain electrode of the NMOS transistor 13 is also connected with the node N3. That is, the NMOS transistor is diode-connected. Also, the voltage generator 10 has a PMOS transistor 14, an NMOS transistor 15 and a resistance element 16 connected in series between the power supply voltage terminal Tcc and the ground voltage terminal Tss. The PMOS transistor 14 has a source electrode connected with the power supply voltage terminal Tcc, a drain electrode connected with the second node N2, and a gate electrode connected with the second node N2. That is, the PMOS transistor 11 is diode-connected, and the PMOS transistors 11 and 14 constitute a first current mirror circuit. The NMOS transistor 15 has a source electrode connected with the ground voltage terminal Tss through the resistance element 16, a drain electrode connected with the second node N2, and a gate electrode connected with the third node N3. That is, the NMOS transistors 13 and 15 constitute a second current mirror circuit. Furthermore, the voltage generator 10 has a PMOS transistor 17 between the power supply voltage terminal Tcc and the node N2. The conductive state of the PMOS transistor 17 is controlled by an inverted signal STBb of a standby mode signal STB. The standby mode signal STB is externally input to the bias circuit. When the bias circuit operates normally, a first bias voltage Vb1 is output from the node N2 and a second bias voltage Vb2 is output from the node N3.

The start-up circuit 20 has a PMOS transistor 21 connected between the power supply voltage terminal Tcc and a voltage dividing node Nd and diode-connected NMOS transistors 22 and 23 connected in series between the voltage dividing node Nd and the ground voltage terminal Tss. The conductive state of the PMOS transistor 21 is controlled by the standby mode signal STB. Furthermore, the start-up circuit 20 has a diode 24 connected between the voltage dividing node Nd and the first node N1 of the voltage generator 10. The diode 24 has an anode connected with the voltage dividing node Nd and a cathode connected with the first node N1. The standby mode signal STB is inverted by an inverter 25, and then the inverted standby mode signal STBb is applied to a gate electrode of the PMOS transistor 17.

Details of the operations with respect to the above-mentioned circuits are described below.

When the bias circuit starts, that is, during a start-up process of the bias circuit, the power supply voltage Vcc is applied to the power supply voltage terminal Tcc with the level of the standby mode signal STB initially kept in a "Low" (hereinafter referred to as "L") level. Then, the PMOS transistor 17 is turned OFF and the PMOS transistor 21 is turned ON. After that, an electrical current passes through the diode-connected NMOS transistors 22 and 23, and then an electrical potential rises on the voltage dividing node Nd. Since the PMOS and NMOS transistors of the voltage generator 10 is kept OFF just after the bias circuit starts, the electrical potential on the voltage dividing node Nd becomes higher than that on the first node N1. Thereby, an electrical current passes through the diode 24 from the voltage dividing node Nd toward the first node N1.

The electrical current flowing into the first node N1 is passed through the resistance element 12 and the NMOS transistor 13 toward the ground voltage terminal. In accordance with the electrical current passing through the NMOS transistor 13, the second current mirror circuit generates an electrical current passing through the NMOS transistor 15. That is, the electrical current whose amount depends on the value of the resistance element 16 passes through the PMOS transistor 14, NMOS transistor 15 and resistance element 16 from the power supply voltage terminal Tcc toward the ground voltage terminal Tss. In addition, based on the electrical current passing through the PMOS transistor 14, the first current mirror circuit generates an electrical current passing through the PMOS transistor 11. Then, the electrical potential on the first node N1 is raised. When the electrical potential difference between the first node N1 and the voltage dividing node Nd becomes lower than a forward-biased voltage, the diode 24 does not allow the electrical current to flow. Consequently, an electrical potential on the second node N2 becomes lower than the power supply voltage Vcc by approximately 1 V, and is output from the voltage generator 10 as the first bias voltage Vb1. An electrical potential on the third node N3 becomes higher than the ground voltage Vss by approximately 1V, and is output from the voltage generator 10 as the second bias voltage Vb2. After that, the bias circuit operates normally.

When the bias circuit operates in a standby mode (a low power consumption mode) after the above-mentioned normal operation mode, the level of the standby mode signal STB turns to a "High" (hereinafter referred to as "H") level. With this change in the level of the standby mode signal STB, the PMOS transistor 17 is turned ON and the PMOS transistor 21 is turned OFF. With the PMOS transistor 21 turned OFF, the electrical current is prevented from passing through the PMOS transistor 21 and the NMOS transistors 22 and 23. On the other hand, with the PMOS transistor 17 turned ON, the PMOS transistors 11 and 14 are turned OFF and the electrical current is prevented from passing through the PMOS transistors 11 and 14. Hereby, the electrical current is also prevented from passing through the NMOS transistors 13 and 15. At this time, the first bias voltage Vb1 becomes approximately the power supply voltage Vcc. As mentioned above, since the bias circuit does not allow the electrical current to pass through the PMOS transistor 21 and the NMOS transistors 22 and 23 in the standby mode, a low power consumption is realized in this bias circuit.

In addition, to further decrease power consumption, a bias circuit has been proposed as described in Document 1 (Japanese Patent Publication Laid-open No. 2001-326535). The bias circuit as described in the Document 1, whose circuit configuration and principle of operation are different from that in the above-mentioned prior art, reduces the consumption of the electrical current in the start-up circuit by using a standby mode signal in the standby mode.

However, in the bias circuit as described above, since the PMOS transistor 21 is turned ON even after the power supply voltage Vcc is stable, the electrical current passes through the PMOS transistor 21 and diode-connected NMOS transistors 22 and 23 in the start-up circuit 20 during the normal operation mode as well as during the start-up process of the bias circuit.

In order to decrease the electrical current passing through the start-up circuit 20 in the normal operation mode, it can be proposed that an ON-state resistance of the PMOS transistor 21 is made greater. In this case, however, it takes a long time to stably output the first and second bias voltages Vref1 and Vref2. That is, since start-up of the bias circuit is slower, it is not effective that the ON-state resistance of the PMOS transistor 21 is merely made greater in order to decrease the power consumption in the start-up circuit 20 in the normal operation mode.

On the other hand, if the above electrical current is completely cut off by turning OFF the PMOS transistor 21 in the start-up circuit 20 in the normal operation mode, the power consumption in the start-up circuit 20 can be decreased. In this case, however, the voltage dividing node Nd becomes electrically unstable. That is, a possibility arises of changing the electrical potential on the voltage dividing node Nd because of a signal transmitting in a peripheral circuit arranged near the bias circuit. For example, an output circuit of a Liquid Crystal Display (hereinafter referred to as "LCD") driver circuit, which operates by a voltage higher than the power supply voltage Vcc, can be taken as the peripheral circuit. If the electrical potential would increase on the voltage dividing node Nd, an electrical current flows from the voltage dividing node Nd to the first node N1 through the diode 24. Then, the first and second bias voltages Vb1 and Vb2 are changed. As a result, a malfunction can occur in a circuit into which the first or second bias voltages Vb1 and Vb2 are input. Therefore, it is desired in the bias circuit that the reference voltage can be quickly output during the start-up process of the bias circuit and that the power consumption can be decreased during the normal operation mode while the bias voltages are stably output.

SUMMARY OF THE INVENTION

According to an aspect of the present invention, there is provided a bias circuit which includes a first MOS transistor coupled between a first reference voltage terminal and a voltage dividing node. The first MOS transistor has a first ON-state resistance. The bias circuit further includes a second MOS transistor coupled in parallel with the first MOS transistor. The second MOS transistor has a second ON-state resistance which is lower than the first ON-state resistance of the first MOS transistor. The bias circuit still further includes a resistance circuit coupled between the voltage dividing node and a second reference voltage terminal, and a voltage generator coupled with the voltage dividing node. The voltage generator outputs the bias voltage in dependence upon an electrical potential on the voltage dividing node.

According to another aspect of the present invention, there is provided a bias circuit which includes a first MOS transistor coupled between a first reference voltage terminal and a voltage dividing node. The first MOS transistor has a first gate width and a first gate length. The bias circuit further includes a second MOS transistor coupled in parallel with the first MOS transistor. The second MOS transistor has a second gate width and a second gate length, and a ratio of the second gate width to the second gate length is greater than a ration of the first gate width to the first gate length. The bias circuit still further includes a resistance circuit coupled between the voltage dividing node and the second reference voltage terminal, and a voltage generator coupled with the voltage dividing node. The voltage generator outputs the bias voltage in dependence upon an electrical potential on the voltage dividing node.

According to the other aspect of the present invention, there is provided a bias circuit which includes a first MOS transistor coupled between a first reference voltage terminal and a voltage dividing node. The first MOS transistor is capable of passing a first ON-state current through itself. The bias circuit further includes a second MOS transistor coupled in parallel with the first MOS transistor. The second MOS transistor is capable of passing a second ON-state current through itself. The second ON-state current is greater than the first ON-state current. The bias circuit still further includes a resistance circuit coupled between the voltage dividing node and the second reference voltage terminal, and a voltage generator coupled with the voltage dividing node. The voltage generator outputs the first and second bias voltages in dependence upon an electrical potential generated on the voltage dividing node.

The above and further aspects and novel features of the invention will more fully appear from the following detailed description, appended claims and the accompanying drawings.

BRIEF DESCRIPTION OF THE DRAWINGS

Table 1 shows the respective state of control signals S1 and S2 and the status of the MOS transistors in the circuit of FIG. 2, for start-up, normal and standby operation modes.

DETAILED DESCRIPTION OF THE PREFERRED EMBODIMENTS

Embodiments of the present invention will be described hereinafter with references to the accompanying drawings. The drawings used for this description illustrate major characteristic parts of embodiments in order that the present invention will be easily understood. However, the invention is not limited by these drawings.

First Preferred Embodiment

Figure 1:
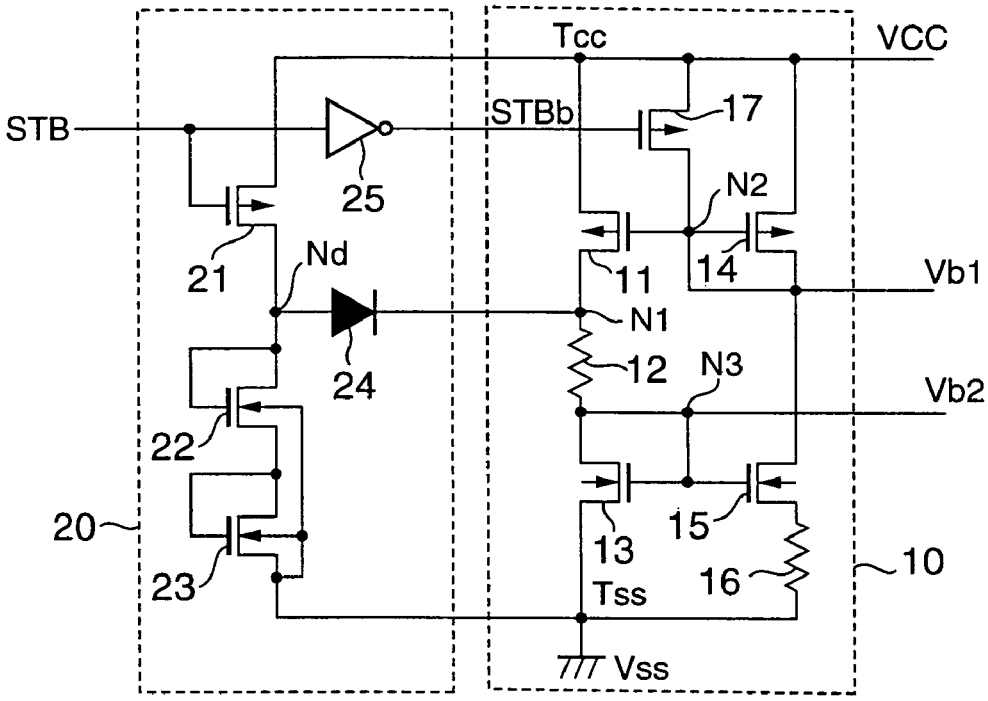
Fig. 1 PRIOR ART
FIG. 1 is a circuit diagram showing a bias circuit of the related art.
Figure 2:
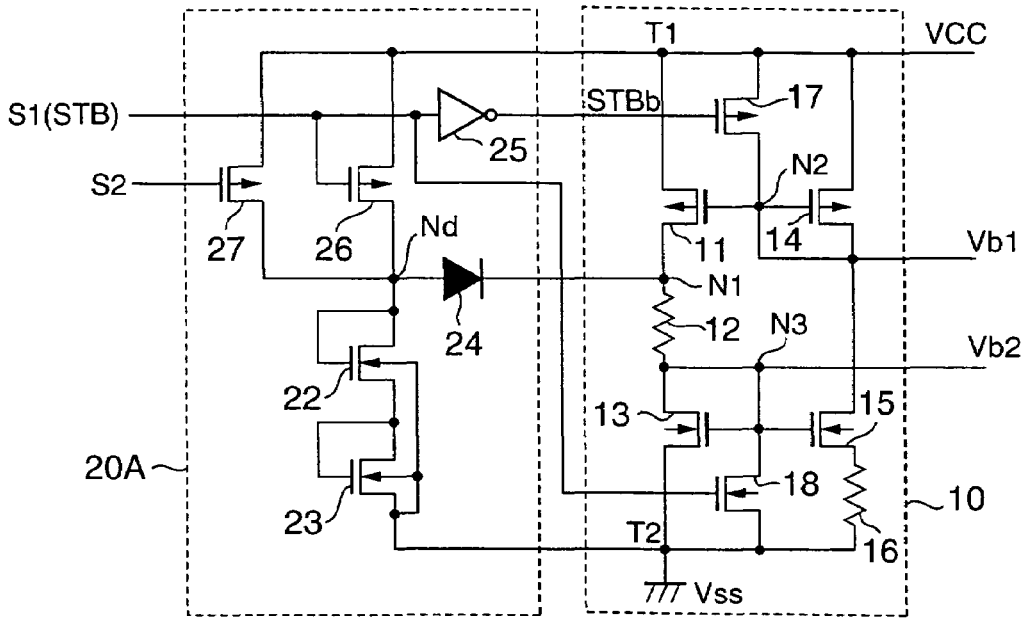
FIG. 2 is a schematic circuit diagram describing a bias circuit according to a first preferred embodiment of the present invention.

FIG. 2 is a schematic circuit diagram describing a bias circuit according to a first preferred embodiment of the present invention. This bias circuit includes a voltage generator 10 which outputs first and second bias voltages Vb1 and Vb2, and a start-up circuit 20A which stably operates the voltage generator 10 when the bias circuit operates in start-up and normal operation modes. The normal operation mode is a mode during which the first and second bias voltages Vb1 and Vb2 are output from the voltage generator 10. The bias circuit generates the first and second bias voltages Vb1 and Vb2, for example, to an LCD driver circuit.

The voltage generator 10 has first and second current mirror circuits coupled with each other between a first reference voltage terminal T1 and a second reference voltage terminal T2. Hereupon, for example, the first reference voltage terminal T1 receives a power supply voltage Vcc and the second reference voltage terminal T2 receives a ground voltage Vss.

The first current mirror circuit includes PMOS transistors 11 and 14. The PMOS transistor 11 has a source electrode coupled with the first reference voltage terminal T1, a drain electrode coupled with first node N1, and a gate electrode coupled with a second node N2 from which the first bias voltage Vb1 is output in the normal operation mode. The PMOS transistor 14 has a source electrode coupled with the first reference voltage terminal T1, a drain electrode and a gate electrode coupled concurrently with the second node N2. That is, the PMOS transistor 14 is diode-connected.

The second current mirror circuit includes NMOS transistors 13 and 15. The NMOS transistor 13 has a source electrode coupled with the second reference voltage terminal T2, a drain electrode and a gate electrode coupled concurrently with a third node N3 from which the second bias voltage Vb2 is output in the normal operation mode. The NMOS transistor 13 is diode-connected as is the PMOS transistor 14. Also, the source and gate electrodes of the NMOS transistor 13 are coupled with the first node N1 through a resistance element 12. The NMOS transistor 15 has a source electrode coupled with the second reference voltage terminal T2 through a resistance element 16, a drain electrode coupled with the second node N2, and a gate electrode coupled with the third node N3. Furthermore, the voltage generator 10 has a PMOS transistor 17 coupled between the first reference voltage terminal T1 and the second node N2, and an NMOS transistor 18 coupled between the third node N3 and the second reference voltage terminal T2.

When the bias circuit is used with the power supply voltage Vcc which ranges approximately from 3V to 6V, the PMOS transistor 14 and the NMOS transistor 13 are designed so that a voltage of approximately 1V can be applied across each of the PMOS transistor 14 and the NMOS transistor 13 when they are turned ON. Also, when the bias circuit is used with the power supply voltage Vcc (for example, 1.8V) which is lower than 2V, the PMOS transistor 14 and the NMOS transistor 13 are designed so that a voltage of approximately 0.5V can be applied across each of the PMOS transistor 14 and the NMOS transistor 13 when they are turned ON. Furthermore, the PMOS transistor 17 is designed so that an ON-state resistance of the PMOS transistor 17 can be much lower than a sum of an ON-state resistance value of the NMOS transistor 15 and a value of the resistance element 16. Likewise, the NMOS transistor 18 is designed so that an ON-state resistance of the NMOS transistor 18 can be much lower than a sum of an ON-state resistance value of the PMOS transistor 11 and a value of the resistance element 12.

The conductive state of the NMOS transistor 18 is controlled by a first control signal S1. For example, a standby mode signal STB can be applied to the first control signal S1. The standby mode signal STB is kept in an "L" level when the bias circuit starts or operates in the normal operation mode and is turned to an "H" level when the bias circuit is in a standby mode. In the standby mode, the bias circuit does not output the first and second bias voltages Vb1 and Vb2 to a circuit with which the bias circuit is coupled. On the other hand, the conductive state of the PMOS transistor 17 is controlled by an inverted signal of the first control signal S1. The inverted signal is generated by an inverter 25. When the standby mode signal STB is applied to the first control signal S1, an output signal from the inverter 25 is an inverted standby mode signal STBb.

The start-up circuit 20A has a first MOS transistor 26 of P-conductive type coupled between the first reference voltage terminal T1 and a voltage dividing node Nd. The conductive state of the first MOS transistor 26 is controlled by the first control signal S1 which is supplied to a gate electrode of the first MOS transistor 26. The first MOS transistor 26 has a first ON-state resistance. The first ON-state resistance allows a first ON-state current which can at least stabilize an electrical potential on the voltage dividing node Nd to pass through the first MOS transistor 26. Preferably, the first ON-state current is equal to or more than 5 μA. Also, the gate electrode of the first MOS transistor 26 has a first gate width and a first gate length.

The start-up circuit 20A has a resistance circuit which generates a constant voltage across itself. That is, the resistance circuit functions as a constant-voltage circuit. In this example, the resistance circuit includes two-terminal circuits having PN-junctions. For example, as shown in FIG. 2, the resistance circuit includes diode-connected NMOS transistors 22 and 23 coupled in series between the voltage dividing node Nd and the second reference voltage terminal T2.

Figure 3:
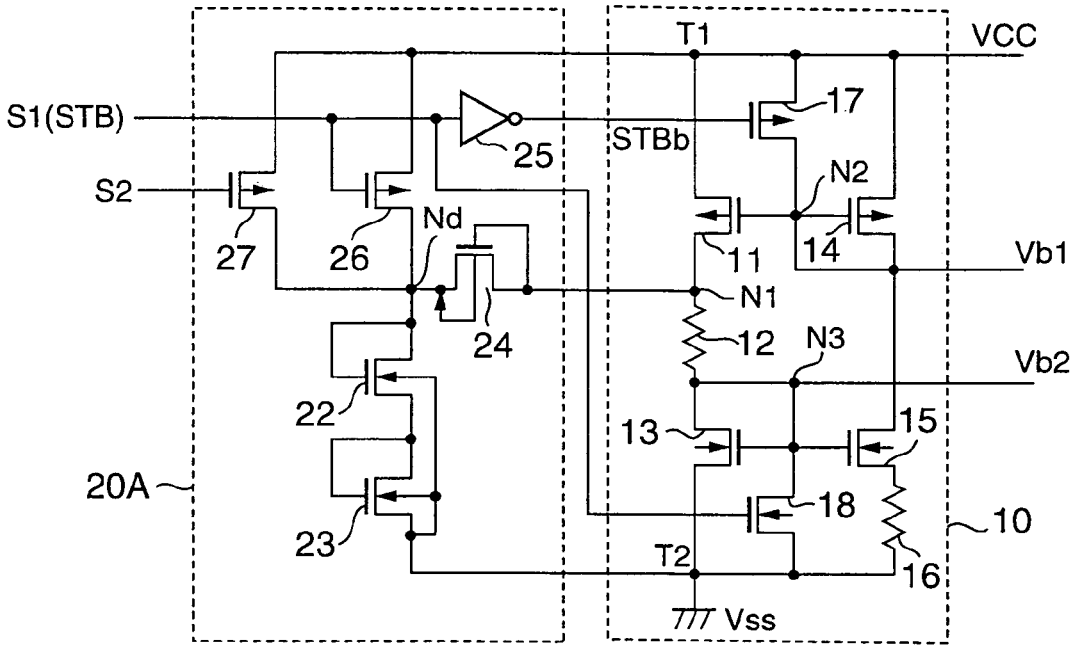
FIG. 3 is another schematic circuit diagram describing a bias circuit according to a first preferred embodiment of the present invention.

Also, a diode 24 is coupled between the voltage dividing node Nd of the start-up circuit 20A and the first node N1 of the voltage generator 10. The diode 24 has an anode coupled with the voltage dividing node Nd and a cathode coupled with the first node N1. In addition, as shown in FIG. 3, a diode-connected PMOS or NMOS transistor can be applied instead of the diode 24 of FIG. 2.

Furthermore, the start-up circuit 20A has a second MOS transistor 27 of P-conductive type coupled in parallel to the first MOS transistor 26 between the first reference voltage terminal T1 and the voltage dividing node Nd. The conductive state of the second MOS transistor 27 is controlled by a second control signal S2 which is supplied to a gate electrode of the second MOS transistor 27. The second control signal S2 is independent of the first control signal S1. The second control signal S2 is kept in "L" level when the bias circuit starts and is turned to "H" level in the normal operation mode and the standby mode. Hereupon, a power-on reset signal can be applied to the second control signal S2. The power-on reset signal is used in order to reset a system including the bias circuit before the bias circuit starts. The second MOS transistor 27 has a second ON-state resistance which is lower than the first ON-state resistance. That is, when the gate electrode of the second MOS transistor 27 has a second gate width and a second gate length, a ratio of the second gate width to the second gate length is greater than a ration of the first gate width to the first gate length. The second ON-state resistance allows a second ON-state current which can rapidly output the first and second bias voltages Vb1 and Vb2 after the bias circuit starts to pass through the second MOS transistor 27. Hereupon, the second ON-state current is greater than the first ON-state current.

The operation of the bias circuit according to the first preferred embodiment of the present invention is described below.

When the bias circuit operates in the start-up operation mode, the first reference voltage terminal T1 receives the power supply voltage Vcc and the levels of the first and second control signals S1 and S2 are set on "L" level as shown in Table 1. Then, the first and second MOS transistor 26 and 27 in the start-up circuit 20A are turned ON and the PMOS transistor 17 and the NMOS transistor 18 in the voltage generator 10 are turned OFF. Thereby, a large electrical current (a sum of the first ON-state current and the second ON-state current) passes through both of the first and second MOS transistors 26 and 27 from the first reference voltage terminal T1 toward the voltage dividing node Nd. Therefore, the electrical potential on the voltage dividing node Nd goes up rapidly. Also, since the voltage dividing node Nd is supplied at least with the first ON-state current by the first MOS transistor 26, the electrical potential on the voltage dividing node Nd gets stable during the start-up process of the bias circuit. After that, when the electrical potential on the voltage dividing node Nd exceeds a sum of threshold voltages of the diode-connected NMOS transistors 22 and 23, the large electrical current passes through the diode-connected NMOS transistors 22 and 23 from the voltage dividing node Nd toward the second reference voltage terminal T2. And then, the electrical potential on the voltage dividing node Nd gets stable. On the other hand, when the bias circuit starts, the PMOS transistor 17 and the NMOS transistor 18 are turned OFF as has been previously described. Thereby, the PMOS transistors 11 and 14 and the NMOS transistors 13 and 15 in the voltage generator 10 are also kept in OFF-states at this time. Therefore, an electrical potential difference between the voltage dividing node Nd and the first node N1 exceeds a forward-biased threshold voltage of the diode 24. Then, an electrical current passes through the diode 24 from the voltage dividing node Nd of the start-up circuit 20A toward the first node N1 of the voltage generator 10. Since the electrical current flows into the first node N1, the electrical potential on the first node N1 goes up. Then, the electrical potential on the third node N3 goes up by the resistance element 12 with the electrical potential on the first node N1 going up. This increasing of the electrical potential on the third node N3 allows the NMOS transistor 13 to turn ON. Consequently, when the electrical current flowing into the first node N1 is referred to as $I_1$, the electrical current $I_1$ passes through the resistance element 12 and the NMOS transistor 13 toward the second reference voltage terminal T2. The second current mirror circuit makes an electrical current $I_2$ to pass through the NMOS transistor 15 as much as through the NMOS transistor 13. That is, the electrical current $I_2$ passes through the PMOS transistor 14, the NMOS transistor 15 and the resistance element 16 from the first reference voltage terminal T1 toward the second reference voltage T2. The amount of the electrical current $I_2$ depends on the value of the resistance element 16. The first current mirror circuit makes an electrical current $I_3$ to pass through the PMOS transistor 11 as much as through the PMOS transistor 14. The electrical potential on the first node N1 goes up with the electrical current $I_3$ generating in the first current mirror circuit. When the electrical potential on the first node N1 rises and the electrical potential difference between the voltage dividing node Nd and the first node N1 gets to be below the forward-biased threshold voltage of the diode 24, the diode 24 does not the electrical current to pass through itself. It follows that the first bias voltage Vb1, which is lower by the voltage applied across the PMOS transistor 14 than power supply voltage Vcc, is output from the second node N2 and that the second bias voltage Vb2, which is higher by the voltage applied across the NMOS transistor 13 than the ground voltage Vss, is output from the third node N3.

Next, when the bias circuit operates normally, the first control signal S1 is kept in the "L" level, and the second control signal S2 is turned to "H" level, as shown in Table 1. Then, the first MOS transistor 26 is kept in ON-state, the PMOS transistor 17 and the NMOS transistor 18 in the voltage generator 10 is kept in OFF-state, and the second MOS transistor 27 is turned to OFF. That is, the first MOS transistor 26 allows the first ON-state current which can stabilize the electrical potential on the voltage dividing node Nd to pass through itself as mentioned above and the second MOS transistor 27 does not allow the second ON-state current to pass through itself. Since the second MOS transistor 27 has the second ON-state resistance which is lower than the first ON-state resistance of the first MOS transistor 26, namely, the second ON-state current is larger than the first ON-state current, the electrical potential on the voltage dividing node Nd gets to be stable by a voltage applied across the first MOS transistor 26 while the amount of the electrical current flowing from the first reference voltage terminal T1 toward the second reference voltage terminal T2 can be decreased. Even if the signal transmits in the other circuit which is arranged next to the bias circuit, it is hard that the electrical potential on the voltage dividing node Nd changes. If the first MOS transistor 26 has a first ON-state resistance which allows only the minimum of the electrical current that can stabilize the electrical potential on the voltage dividing node Nd, the electrical potential on the voltage dividing node Nd can be stabilized while the amount of the electrical current in the start-up circuit 20A can be more decreased. Hereupon, the first and second bias voltages Vb1 and Vb2 are output from the voltage generator 10 in this normal operation mode as well as before the level of the second control signal S2 is turned to "H" level.

Next, when the bias circuit operates in the standby mode (the low power consumption mode) after the above-mentioned normal operation mode, the first control signal S1 is turned to "H" level and the second control signal S2 is kept in the "H" level as well as in the normal operation mode as shown in Table 1. Then, both of the first MOS transistor 26 and the second MOS transistors 27 are turned OFF. Therefore, the electrical current does not flow between the first reference voltage terminal T1 and the second reference voltage terminal T2 in the start-up circuit 20A. On the other hand, both of the PMOS transistor 17 and the NMOS transistor 18 of the voltage generator 10 are turned ON in the standby mode. Also, since the ON-state resistances of the PMOS transistor 17 and the NMOS transistor 18 are designed so as to be much lower as stated above, the power supply voltage Vcc is supplied to the gate electrodes of the PMOS transistors 11 and 14 and the ground voltage Vss is supplied to the gate electrodes of the NMOS transistors 13 and 15. Then, the PMOS transistors 11 and 14 are turned OFF and the NMOS transistors 13 and 15 are turned OFF. Thereby, the first bias voltage Vb1 is kept substantially equal to the power supply voltage Vcc and the second bias voltage Vb2 is kept substantially equal to the ground voltage Vss in the standby mode.

Furthermore, when the bias circuit operates in the normal operation mode once again after the above-mentioned standby mode, the first control signal S1 is turned from the "H" level to "L" level and the second control signal S2 is kept in the "H" level as shown in Table 1. Then, since the first MOS transistor 26 is turned ON and the second MOS transistor 27 is kept in OFF-state in the start-up circuit 20A, the electrical potential on the voltage dividing node Nd is kept stable while the amount of the electrical current is limited between the first reference voltage terminal T1 and the second reference voltage terminal T2 in the start-up circuit 20A. Also, in the voltage generator 10, the first bias voltage Vb1, which is lower by the voltage applied across the PMOS transistor 14 than power supply voltage Vcc, is output from the second node N2 and that the second bias voltage Vb2, which is higher by the voltage applied across the NMOS transistor 13 than the ground voltage Vss, is output from the third node N3.

According to the first preferred embodiment, the first MOS transistor having a first ON-state resistance and the second MOS transistor having a second ON-state resistance are coupled in parallel between the first reference voltage terminal and the voltage dividing node in the start-up circuit, and also, the second ON-state resistance is lower than the first ON-state resistance. When the bias circuit starts, the voltage dividing node of the start-up circuit, which is coupled with the voltage generator, is supplied with the first and second ON-state currents by turning ON both of the first MOS transistor and the second MOS transistor. Also, when the bias circuit operates normally, the voltage dividing node of the start-up circuit is supplied with the first ON-state current by turning ON the first MOS transistor and turning OFF the second MOS transistor. That is, the voltage dividing node is supplied at least with the first ON-state current not only during the start-up process of the bias circuit but also during the normal operation mode. Therefore, during the start-up process of the bias circuit, the electrical potential on the voltage dividing node of the start-up circuit can be rapidly raised while the electrical potential on the voltage dividing node can be stable. On the other hand, during the normal operation mode, the amount of the electrical current flowing from the first reference voltage terminal toward the second reference voltage terminal in the start-up circuit can be decreased while the electrical potential on the voltage dividing node can be stable with the influence from the peripheral circuit suppressed. As a result, in the bias circuit, the bias voltage can be quickly output during the start-up process and the power consumption can be decreased during the normal operation mode while the bias voltages are stably output.

Second Preferred Embodiment

Figure 4:
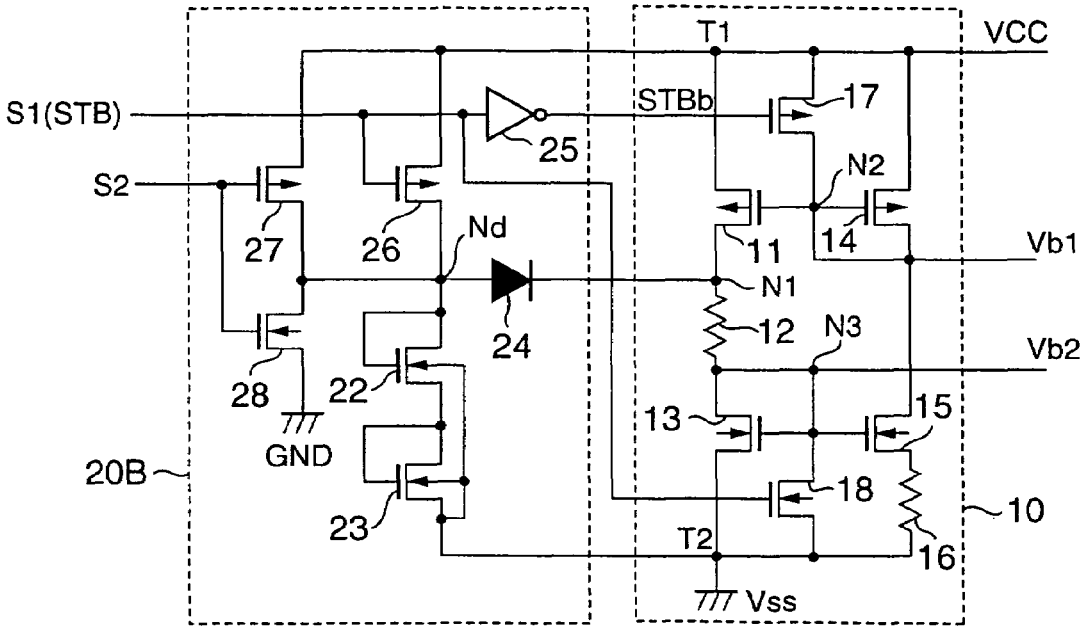
FIG. 4 is a schematic circuit diagram describing a bias circuit according to a second preferred embodiment of the present invention.

FIG. 4 is a schematic circuit diagram describing a bias circuit according to a second preferred embodiment of the present invention. The configuration of the start-up circuit 20B in the bias circuit according to the second preferred embodiment is different from that according to the first preferred embodiment. The other configurations of the bias circuit according to the second preferred embodiment are the same as those according to the first preferred embodiment.

The start-up circuit 20B has a third MOS transistor 28 of N-conductive type coupled between the voltage dividing node Nd and the second reference voltage terminal T2. That is, the NMOS transistor 28 is coupled in series with the second MOS transistor 27 and has a different conductive type from the second MOS transistor 27. The conductive state of the third MOS transistor 28 is controlled by the second control signal S2. Also, the third MOS transistor 28 has a third ON-state resistance which is much smaller than the first ON-state resistance of the first MOS transistor 26. That is, when the third MOS transistor 28 has a third gate width and a third gate length, a ratio of the third gate width to the third gate length is much greater than a ratio of the first gate width to the first gate length of the first MOS transistor 26.

As mentioned above in the first preferred embodiment, the second control signal S2 is kept in the "L" level during the start-up process of the bias circuit and is turned to the "H" level during both of the normal operation mode and the standby mode. Thereby, the third MOS transistor 28 is turned ON during the normal operation mode and the standby mode. Hereupon, since the third ON-state resistance is much smaller than the first ON-state resistance as stated above, the electrical potential on the voltage dividing node Nd is stably kept substantially in a level of the ground voltage Vss during the normal operation mode and the standby mode. Therefore, the voltage generator 10 stably outputs the first and second bias voltages Vb1 and Vb2 while the influence from the peripheral circuit which is arranged near the bias circuit is suppressed and the operation of the bias circuit changes at short times from the standby mode to the normal operation mode. In the second preferred embodiment, the third MOS transistor 28 can be also controlled by the first control signal S1 which controls the first MOS transistor 26 instead of the second control signal S2 which controls the second MOS transistor 27.

According to the second preferred embodiment, in addition to the effects realized in the first preferred embodiment, the bias circuit can not only output the bias voltages more stably, but also quickly switch from the standby mode to the normal operation mode.

What is claimed is:

1. A bias circuit which generates a bias voltage, comprising:

a first MOS transistor coupled between a first reference voltage terminal and a voltage dividing node, wherein the first MOS transistor has a first ON-state resistance;

a second MOS transistor coupled in parallel with the first MOS transistor, wherein the second MOS transistor has a second ON-state resistance which is lower than the first ON-state resistance of the first MOS transistor;

a resistance circuit coupled between the voltage dividing node and a second reference voltage terminal;

a voltage generator coupled with the voltage dividing node, the voltage generator outputting the bias voltage in dependence upon an electrical potential on the voltage dividing node, wherein the resistance circuit is a constant-voltage circuit; and a two-terminal circuit element having a PN-junction which is coupled between the voltage dividing node and the voltage generator, wherein the voltage generator outputs the bias voltage in accordance with a voltage across the two-terminal circuit element.

2. The bias circuit according to claim 1, wherein the two-terminal circuit element is a diode-connected MOS transistor.

3. The bias circuit according to claim 1, wherein the first MOS transistor is controlled by a first control signal, and wherein the second MOS transistor is controlled by a second control signal which is independent of the first control signal.

4. The bias circuit according to claim 3, wherein the first and second control signals turn ON the first and second MOS transistors before the voltage generator outputs the bias voltage, and wherein the first control signal turns ON the first MOS transistor and the second control signal turns OFF the second MOS transistor after the voltage generator outputs the bias voltage.

5. The bias circuit according to claim 3, wherein the voltage generator is controlled by the first control signal.

6. The bias circuit according to claim 3, wherein the first control signal is a standby signal.

7. The bias circuit according to claim 1, wherein a conductive type of the first MOS transistor is the same as a conductive type of the second MOS transistor.

8. A bias circuit which generates a bias voltage, comprising:

a first MOS transistor coupled between a first reference voltage terminal and a voltage dividing node, wherein the first MOS transistor has a first ON-state resistance;

a second MOS transistor coupled in parallel with the first MOS transistor, wherein the second MOS transistor has a second ON-state resistance which is lower than the first ON-state resistance of the first MOS transistor;

a resistance circuit coupled between the voltage dividing node and a second reference voltage terminal;

a voltage generator coupled with the voltage dividing node, the voltage generator outputting the bias voltage in dependence upon an electrical potential on the voltage dividing node, wherein the resistance circuit is a constant-voltage circuit; and a third MOS transistor coupled between the voltage dividing node and the second reference voltage terminal, wherein a conductive type of the third MOS transistor is different than a conductive type of the second MOS transistor.

9. The bias circuit according to claim 8, wherein the third MOS transistor has a third ON-state resistance which is lower than the first ON-state resistance of the first MOS transistor.

10. The bias circuit according to claim 8, wherein the third MOS transistor is turned ON when the second MOS transistor is turned OFF.

11. The bias circuit according to claim 8, wherein the third MOS transistor is turned ON when the first MOS transistor is turned OFF.

12. The bias circuit according to claim 1, wherein the electrical potential on the voltage dividing node is generated based on an electrical current passing through the first and second MOS transistors and the resistance circuit.

13. The bias circuit according to claim 1, wherein the first reference voltage terminal receives a power supply voltage and the second reference voltage terminal receives a ground voltage.

14. The bias circuit according to claim 1, wherein the first ON-state resistance allows a current of at least 5 μA to pass through the first MOS transistor.

15. A bias circuit which generates a bias voltage, comprising:

a first MOS transistor coupled between a first reference voltage terminal and a voltage dividing node, wherein the first MOS transistor has a first ON-state resistance;

a second MOS transistor coupled in parallel with the first MOS transistor, wherein the second MOS transistor has a second ON-state resistance which is lower than the first ON-state resistance of the first MOS transistor;

a resistance circuit coupled between the voltage dividing node and a second reference voltage terminal; and a voltage generator coupled with the voltage dividing node, the voltage generator outputting the bias voltage in dependence upon an electrical potential on the voltage dividing node, wherein the voltage generator includes an output terminal from which the bias voltage is output, a first current mirror circuit coupled between the first reference voltage terminal and the output terminal, wherein the first current mirror circuit includes two P-type MOS transistors, and a second current mirror circuit coupled between the output terminal and the second reference voltage terminal, wherein the second current mirror circuit includes two N-type MOS transistors.

16. A bias circuit which generates a bias voltage, comprising:

a first MOS transistor coupled between a first reference voltage terminal and a voltage dividing node, wherein the first MOS transistor has a first gate width and a first gate length;

a second MOS transistor coupled in parallel with the first MOS transistor, wherein the second MOS transistor has a second gate width and a second gate length, and wherein a ratio of the second gate width to the second gate length is greater than a ratio of the first gate width to the first gate length;

a resistance circuit coupled between the voltage dividing node and the second reference voltage terminal;

a voltage generator coupled with the voltage dividing node, the voltage generator outputting the bias voltage in dependence upon an electrical potential on the voltage dividing node, wherein the resistance circuit is a constant-voltage circuit; and a PN-junction circuit which is coupled between the voltage dividing node and the voltage generator, wherein the voltage generator outputs the bias voltage in accordance with a voltage across the PN-junction circuit.

17. The bias circuit according to claim 16, wherein the PN-junction circuit is a diode-connected MOS transistor.

18. The bias circuit according to claim 16, wherein the first MOS transistor is controlled by a first control signal, and wherein the second MOS transistor is controlled by a second control signal which is independent of the first control signal.

19. The bias circuit according to claim 18, wherein the first and second control signals turn ON the first and second MOS transistors before the voltage generator outputs the bias voltage, and wherein the first control signal turns ON the first MOS transistor and the second control signal turns OFF the second MOS transistor after the voltage generator outputs the bias voltage.

20. The bias circuit according to claim 18, wherein the voltage generator is controlled by the first control signal.

21. The bias circuit according to claim 18, wherein the first control signal is a standby signal.

22. The bias circuit according to claim 16, wherein a conductive type of the first MOS transistor is the same as a conductive type of the second MOS transistor.

23. A bias circuit which generates a bias voltage, comprising:

a first MOS transistor coupled between a first reference voltage terminal and a voltage dividing node, wherein the first MOS transistor has a first gate width and a first gate length;

a second MOS transistor coupled in parallel with the first MOS transistor, wherein the second MOS transistor has a second gate width and a second gate length, and wherein a ratio of the second gate width to the second gate length is greater than a ratio of the first gate width to the first gate length;

a resistance circuit coupled between the voltage dividing node and the second reference voltage terminal;

a voltage generator coupled with the voltage dividing node, the voltage generator outputting the bias voltage in dependence upon an electrical potential on the voltage dividing node, wherein the resistance circuit is a constant-voltage circuit; and a third MOS transistor coupled between the voltage dividing node and the second reference voltage terminal, wherein a conductive type of the third MOS transistor is different than a conductive type of the second MOS transistor.

24. The bias circuit according to claim 23, wherein the third MOS transistor has a third gate width and a third gate length, a ratio of the third gate width to the third gate length being greater than the ratio of the first gate width to the first gate length.

25. The bias circuit according to claim 23, wherein the third MOS transistor is turned ON when the second MOS transistor is turned OFF.

26. The bias circuit according to claim 23, wherein the third MOS transistor is turned ON when the first MOS transistor is turned OFF.

27. The bias circuit according to claim 16, wherein the electrical potential on the voltage dividing node is generated based on an electrical current passing through the first and second MOS transistors and the resistance circuit.

28. The bias circuit according to claim 16, wherein the first reference voltage terminal receives a power supply voltage and the second reference voltage terminal receives a ground voltage.

29. The bias circuit according to claim 16, wherein the first gate width and the first gate length allow a current of at least 5 μA to pass through the first MOS transistor.

30. A bias circuit which generates a bias voltage, comprising:

a first MOS transistor coupled between a first reference voltage terminal and a voltage dividing node, wherein the first MOS transistor has a first gate width and a first gate length;

a second MOS transistor coupled in parallel with the first MOS transistor, wherein the second MOS transistor has a second gate width and a second gate length, and wherein a ratio of the second gate width to the second gate length is greater than a ratio of the first gate width to the first gate length;

a resistance circuit coupled between the voltage dividing node and the second reference voltage terminal; and a voltage generator coupled with the voltage dividing node, the voltage generator outputting the bias voltage in dependence upon an electrical potential on the voltage dividing node, wherein the voltage generator includes an output terminal from which the bias voltage is output, a first current mirror circuit coupled between the first reference voltage terminal and the output terminal, wherein the first current mirror circuit includes two P-type MOS transistors, and a second current mirror circuit coupled between the output terminal and the second reference voltage terminal, wherein the second current mirror circuit includes two N-type MOS transistors.

31. A bias circuit which generates first and second bias voltages, comprising:

a first MOS transistor coupled between a first reference voltage terminal and a voltage dividing node, wherein the first MOS transistor is capable of passing a first ON-state current therethrough;

a second MOS transistor coupled in parallel with the first MOS transistor, wherein the second MOS transistor is capable of passing a second ON-state current therethrough, the second ON-state current being greater than the first ON-state current;

a resistance circuit coupled between the voltage dividing node and the second reference voltage terminal; and a voltage generator coupled with the voltage dividing node, the voltage generator outputting the first and second bias voltages in dependence upon an electrical potential generated on the voltage dividing node, wherein the resistance circuit is a constant-voltage circuit.

32. The bias circuit according to claim 31, further comprising:

a diode which is coupled between the voltage dividing node and the reference voltage generator, wherein the reference voltage generator outputs the first and second bias voltages in accordance with a voltage applied across the diode.

33. The bias circuit according to claim 32, wherein the diode is a diode-connected MOS transistor.

34. The bias circuit according to claim 31, wherein the first MOS transistor receives a first control signal and the second MOS transistor receives a second control signal different from the first control signal, and wherein an amount of the first ON-state current is controlled by the first control signal and an amount of the second ON-state current is controlled by the second control signal.

35. The bias circuit according to claim 34, wherein the first and second control signals turn ON the first and second MOS transistors before the voltage generator outputs the first and second bias voltages, and wherein the first control signal turns ON the first MOS transistor and the second control signal turns OFF the second MOS transistor after the voltage generator outputs the first and second bias voltages.

36. The bias circuit according to claim 34, wherein the voltage generator is controlled by the first control signal.

37. The bias circuit according to claim 34, wherein the first control signal is a standby signal.

38. The bias circuit according to claim 31, wherein a conductive type of the first MOS transistor is the same as a conductive type of the second MOS transistor.

39. The bias circuit according to claim 31, further comprising:

a third MOS transistor coupled between the voltage dividing node and the second reference voltage terminal, wherein a conductive type of the third MOS transistor is different than a conductive type of the second MOS transistor.

40. The bias circuit according to claim 39, wherein the third MOS transistor can pass a third ON-state current therethrough, the third ON-state current being larger than the first ON-state current.

41. The bias circuit according to claim 39, wherein the third MOS transistor is turned ON when the second MOS transistor is turned OFF.

42. The bias circuit according to claim 39, wherein the third MOS transistor is turned ON when the first MOS transistor is turned OFF.

43. The bias circuit according to claim 31, wherein the electrical potential on the voltage dividing node is generated based on an electrical current passing through the first and second MOS transistors and the resistance circuit.

44. The bias circuit according to claim 31, wherein the first reference voltage terminal receives a power supply voltage and the second reference voltage terminal receives a ground voltage.

45. The bias circuit according to claim 31, wherein the first ON-state current is equal to or more than 5 μA.

46. A bias circuit which generates first and second bias voltages, comprising:

a first MOS transistor coupled between a first reference voltage terminal and a voltage dividing node, wherein the first MOS transistor is capable of passing a first ON-state current therethrough;

a second MOS transistor coupled in parallel with the first MOS transistor, wherein the second MOS transistor is capable of passing a second ON-state current therethrough, the second ON-state current being greater than the first ON-state current;

a resistance circuit coupled between the voltage dividing node and the second reference voltage terminal; and a voltage generator coupled with the voltage dividing node, the voltage generator outputting the first and second bias voltages in dependence upon an electrical potential generated on the voltage dividing node, wherein the voltage generator includes first and second output terminals from which the first and second bias voltages are respectively output, a first current mirror circuit coupled between the first reference voltage terminal and the first output terminal, wherein the first current mirror circuit includes two P-type MOS transistors, and a second current mirror circuit coupled between the second output terminal and the second reference voltage terminal, wherein the second current mirror circuit includes two N-type MOS transistors.

* * * * *